US009132902B2

(12) United States Patent
Angelle

(10) Patent No.: US 9,132,902 B2
(45) Date of Patent: Sep. 15, 2015

(54) MARINE DRIVE SYSTEM AND METHOD

(71) Applicant: Clinton J. Angelle, Breaux Bridge, LA (US)

(72) Inventor: Clinton J. Angelle, Breaux Bridge, LA (US)

( * ) Notice: Subject to any disclaimer, the term of this patent is extended or adjusted under 35 U.S.C. 154(b) by 2 days.

(21) Appl. No.: 14/206,897

(22) Filed: Mar. 12, 2014

(65) Prior Publication Data

US 2014/0271189 A1 Sep. 18, 2014

Related U.S. Application Data

(60) Provisional application No. 61/777,331, filed on Mar. 12, 2013.

(51) Int. Cl.

| | |
|---|---|
| ***B63H 5/20*** | (2006.01) |
| ***B63H 5/125*** | (2006.01) |
| ***B63H 20/08*** | (2006.01) |
| ***B63H 23/34*** | (2006.01) |

(52) U.S. Cl.

CPC ..... *B63H 23/34* (2013.01); *B63H 2023/348* (2013.01)

(58) Field of Classification Search

CPC ..... B63H 23/00; B63H 23/26; B63H 23/32; B63H 23/34; B63H 2023/348; B63H 25/00; B63H 25/42; B63H 2023/00; B63H 2023/32; B63H 2025/42; B63H 2025/425

USPC ..... 440/49, 53, 55, 57, 61 R, 61 S, 61 A, 440/61 C, 61 T, 61 D, 61 E, 61 F, 61 G, 62, 63, 440/66, 71, 72, 75, 76, 78, 79, 81, 82, 83, 440/84

See application file for complete search history.

(56) References Cited

U.S. PATENT DOCUMENTS

| | | | | |
|---|---|---|---|---|
| 941,827 | A | 11/1909 | Trouche | |
| 3,933,116 | A * | 1/1976 | Adams et al. | 440/57 |
| 5,328,396 | A | 7/1994 | Hayasaka | |
| 5,349,818 | A | 9/1994 | McFadyen et al. | |
| 6,042,434 | A | 3/2000 | Nakamura | |
| 6,361,388 | B2 | 3/2002 | Foreman | |
| 6,558,212 | B2 | 5/2003 | Saito | |
| 6,607,410 | B1 | 8/2003 | Neisen et al. | |
| 6,902,449 | B1 * | 6/2005 | Faucheux et al. | 440/57 |
| 7,254,945 | B1 | 8/2007 | Sakai et al. | |

(Continued)

FOREIGN PATENT DOCUMENTS

| | | |
|---|---|---|
| EP | 0869056 | 7/1998 |

*Primary Examiner* — Daniel V Venne

(57) ABSTRACT

An improved marine drive system for a marine vessel includes a longitudinally extending drive shaft assembly, a hydraulic cylinder and piston assembly pivotally attached between the drive shaft assembly and the vessel. The cylinder has a first fluid filled cylinder chamber that retains a coiled spring that urges a translatable cylinder piston through a second fluid cylinder chamber to extend the piston rod from said hydraulic cylinder lowering the drive shaft assembly. Fluid lines in communication with switch controlled valves allow for selective evacuation of fluid from the first fluid filled chamber to reduce fluid pressure to move the piston in response to fluid pressure in the second cylinder chamber to collapse the spring to retract the rod to raise the drive shaft assembly. An additional fluid line and switch controlled valve allows for selective removal of fluid from the second fluid filed chamber to reduce fluid pressure to move the piston in response to the spring to extend the rod to lower the subsequently raised drive shaft assembly.

29 Claims, 7 Drawing Sheets

(56) References Cited

U.S. PATENT DOCUMENTS

| | | | |
|---|---|---|---|
| 7,297,035 | B2 | 11/2007 | Broussard |
| 8,277,266 | B2 | 10/2012 | Inoue et al. |
| 2011/0033298 | A1 | 2/2011 | Misao |
| 2012/0214368 | A1 | 8/2012 | Buzzi |

* cited by examiner

MARINE DRIVE SYSTEM AND METHOD

PRIORITY

This application claims priority to U.S. Provisional Application Ser. No. 61/777,331 filed Mar. 12, 2013 for Marine Drive System and Method, the entire content of which is incorporated by reference.

FIELD OF INVENTION

This invention relates to marine drive systems for vessels. More particularly, the present invention relates to a marine drive system and method for vessels used in waterway environments having waterway obstructions and other impediments to navigation. Still more particularly, but without limitation, the present invention relates to a marine drive system and method for vessels used in shallow, marshy, or swampy waterways or in waterways where underwater obstructions are likely to be encountered.

BACKGROUND OF THE INVENTION

The typical drive system for used propelling a marine vessel has an engine or motor, a transmission, and an associated drive shaft assembly. The drive shaft assembly will have a drive shaft housing encasing a rotating drive shaft configured with the engine transmission and a rotatable propeller assembly and will have associated bearing assemblies. The drive shaft housing typically extends outwardly from the stem of the vessel with the propeller assembly and at least a portion of the drive housing positioned below the bottom of the vessel.

In many marine drive systems the drive shaft housing will extend downward below the bottom of the vessel at a position that is perpendicular, or approaching perpendicular, to the water surface depending upon the upward or downward adjustment or trim of the drive housing employed during operation of the vessel. When the drive shaft housing and propeller assembly extend below the bottom of the vessel, both are completely exposed to waterway obstructions such as tree stumps, underwater humps, reefs, floating or underwater debris particularly when the vessel is traversing a waterway.

When the vessel is propelled in shallow waterways, such as marshes or swamps, waterway obstructions such as floating and underwater vegetation, tree limbs, branches, roots, mud bottoms, rocks, and reefs are likely to be encountered. If a waterway obstruction is encountered, the components of the marine drive system may be severely damaged. A damaged drive shaft or propeller assembly will cause the vessel to lose propulsion and may create an inability to steer or further operate the vessel, all providing a potential safety hazard and risk of harm to the vessel operator, any passengers, and other vessels in the vicinity. Repairing the resulting damage to these assemblies may be time consuming and expensive.

Consequently, there is a need for an improved drive system for marine vessels that will minimize or eliminate the risk of drive system damage caused by waterway obstructions.

SUMMARY OF THE INVENTION

The invention is an improved marine drive system for a marine vessel. The system includes a longitudinally extending drive shaft assembly pivotally attached to the vessel to extend outward from the stern of the vessel. A hydraulic cylinder with an internal movable or translatable cylinder piston and rod pivotally attached between the vessel and the drive shaft assembly whereby movement of the cylinder piston within the hydraulic cylinder will extend and retract the piston cylinder rod from and into the hydraulic cylinder and correspondingly raise and lower the pivotally attached outwardly extending drive shaft assembly with respect to the bottom of the vessel. An internal coiled spring is positioned within the hydraulic cylinder to provide a spring force against cylinder piston to extend the piston rod from the cylinder and lower the drive shaft assembly to a default or float mode position.

A hydraulic cylinder fluid line is provided to fluidly connect the hydraulic cylinder to a hydraulic fluid reserve tank. The hydraulic fluid line has a fluid connection on the hydraulic cylinder where a controlled flow of hydraulic fluid moving to and from the fluid reserve tank and the hydraulic cylinder will correspondingly adjust pressure on the hydraulic cylinder piston to compress the internal spring to retract the cylinder piston rod into the hydraulic cylinder. Retraction of the cylinder piston rod by the adjusted pressure of the hydraulic fluid on the cylinder piston raises the drive shaft assembly to a pressure mode position. A means for controlling the flow of hydraulic fluid moving to and from the fluid reserve tank and the hydraulic cylinder is also provided.

The system may include a trim system having an hydraulic fluid trim pump having an up trim mode and a down trim mode operatively connected to the hydraulic cylinder and a hydraulic fluid supply. The fluid trim pump allows for adjustment of the vertical position of the drive shaft assembly to a desired position or trim during vessel operation. The system also includes fluid supply lines, switches, and valves for fluidly connecting and controlling the trim pump, the hydraulic fluid reserve, the hydraulic fluid supply, and the hydraulic cylinder.

Figure 1:
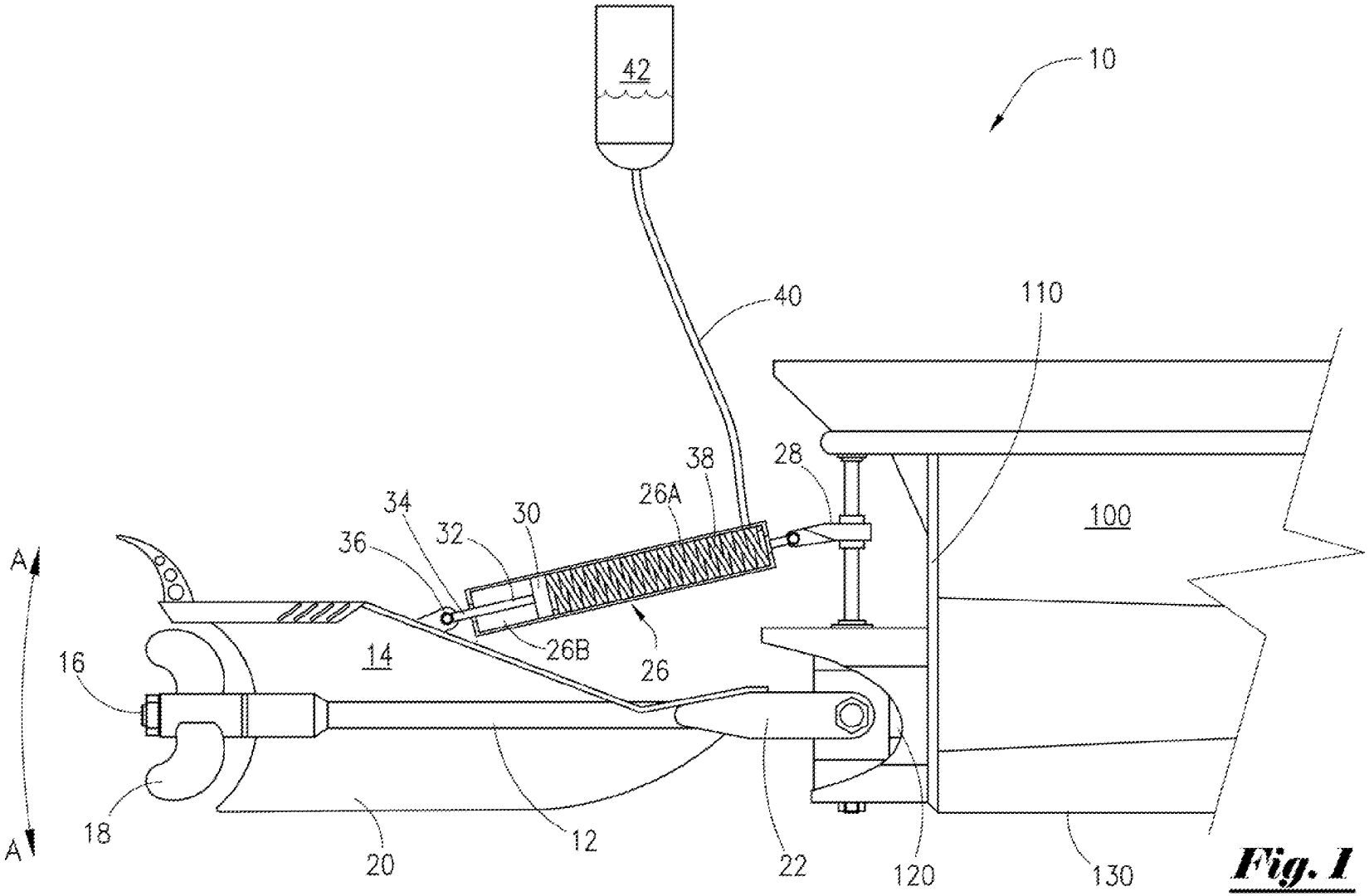
FIG. 1 is a schematic diagram of an embodiment of the marine drive system.

In the Drawings and following Description of the Embodiments, features that are well known and established in the art and do not bear upon points of novelty are omitted in the interest of descriptive clarity. Such omitted features include threaded junctures, tubing clamps, flanged connections, check valves, weld lines, universal joint descriptions, pivoting connection descriptions, sealing elements, pins, brazed junctures, bearings, bolts, and screws.

DESCRIPTION OF THE EMBODIMENTS

The improved marine drive system (10) for a motor driven marine vessel (100) is shown in FIG. 1. The marine drive system (10) is comprised of a longitudinally extending drive shaft assembly (12) having a housing (14) that encloses a drive shaft (16), associated bearing assemblies (not shown), a propeller assembly (18), and a skeg (20). The proximal end (22) of drive shaft assembly (12) is pivotally attached at the stern (110) of the vessel (100) by a universal joint mechanism (120) so as to allow the drive shaft assembly (12) to extend outward from vessel stern (110), preferably to coincide with the centerline or keel line of the vessel (100).

Figure 7:
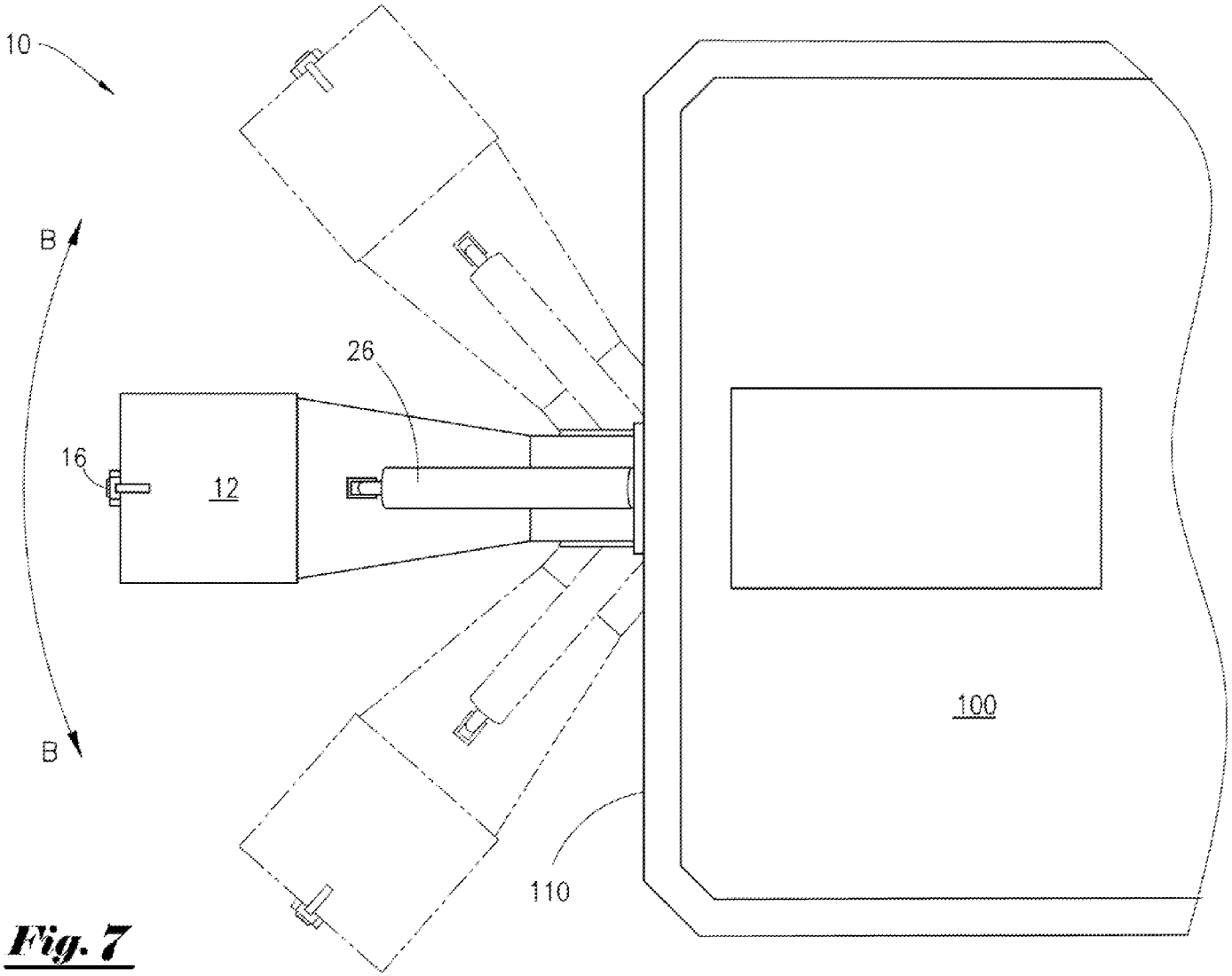
FIG. 7 is a top view of the marine drive system of FIG. 1 operatively attached to the stern of a vessel.

The universal joint (120) is configured to allow the drive shaft assembly (12) to be selectively pivoted both vertically, i.e., upward or downward with respect to the bottom (130) of the vessel (100) along an arc designated as A-A, and horizontally, i.e., toward the port or starboard side of the vessel (100) along an arc designated as B-B, shown in FIG. 7. The horizontal movement of the draft shaft assembly (12) allows the marine drive system (10) to be provided with and adapted to a steering assembly. It is thought that a conventional hydraulic marine steering assembly will be utilized, but a variety of conventional marine steering mechanisms may be utilized. The drive shaft (16) is attached to the motor or engine power assembly of the vessel (100) by a universal joint to allow pivotal movement vertically and horizontally in relation to the pivotal movement of the drive shaft assembly (12) on universal joint (120) and to transmit torque and rotation to the propeller assembly (18).

System (10) is further comprised of a hydraulic cylinder (26) having an internal movable or translatable cylinder piston (30) and a piston rod (32) with one end attached to the piston (30) and a distal end (34) extending away from the piston (30). Piston (30) is positioned in cylinder (26) to create a cylinder chamber or area (26A) and a cylinder chamber or area (26B) on opposite sides of the piston (30). Piston (30) is oriented in cylinder (26) so that attached piston rod (32) extends though cylinder area (26B) with the distal rod end (34) extending axially outward from cylinder (26).

A coiled internal spring (38) is positioned in area (26A) above cylinder piston (30) within the hydraulic cylinder (26). Spring (38) has a spring constant such that when there is fluid filling cylinder (26), including cylinder areas (26A) and (26B), the spring force generated on piston (32) by extension of coiled spring (38) will translate piston (30) toward the piston rod end of cylinder (26). The translation of piston (30) toward the piston end of cylinder (26) contracts or reduces the enclosed volume of cylinder area (26B), expands the area or volume of cylinder area (26A), and increasingly extends piston rod (32) from cylinder (26). The spring constant of spring (38) is also such that when fluid is removed from cylinder area (26A), fluid pressure in cylinder area (26B) will urge piston (30) toward the spring end of cylinder (26) to compress spring (38), reduce or contract the area or volume of cylinder area (26A), and retracts piston rod (32) into cylinder (26).

The hydraulic cylinder (26) end opposite the extending piston rod (32) is pivotally attached to the vessel (100) at universal joint (28). Universal joint (28) configured to allow hydraulic cylinder (26) to pivot vertically and horizontally in relation to the pivotal movement of the drive shaft assembly (12) on universal joint (120). The extending distal rod end (34) of the piston rod (32) is pivotally attached at pivot connection (36) to the housing (14) of the drive shaft assembly (12) whereby translational movement of the cylinder piston (30) within the hydraulic cylinder (26) will extend or retract the piston cylinder rod (32) from and into the hydraulic cylinder (26) and correspondingly pivot the drive shaft assembly vertically on universal joint (12) to raise or lower the drive shaft assembly (12) with respect to the bottom (130) of the vessel (100).

To place the system (10) in operation hydraulic cylinder (26) is filled with hydraulic fluid, including cylinder area (26A) above the piston (30) and cylinder area (26B) below the piston (30), to equalize fluid pressure on the piston (30). The spring (30) provides a biasing force against cylinder piston (30) moving or translating the piston (30) within the cylinder (26) and extending the piston rod (32) from the cylinder (26). Extension of piston rod (30) pivots the drive shaft assembly vertically at universal joint (120) and lowers the drive shaft assembly (12) with respect to the vessel bottom (130). Extending the piston rod (32), by full extension of spring (38) within cylinder (26), lowers the drive shaft assembly (12) to its default or float mode position.

A hydraulic cylinder fluid line (40) is provided to fluidly connect to a hydraulic fluid reserve tank (42) to a fluid connection on the hydraulic cylinder (26) at a position in area (26A) above the piston (30). A controlled flow of hydraulic fluid moving through fluid line (40), to and from fluid reserve tank (42) and the hydraulic cylinder (26) is provided.

The drive shaft assembly (12) is raised by removing or evacuating fluid from cylinder area (26A) above the piston (30) through fluid line (40) to relieve fluid pressure. The evacuating fluid from cylinder area (26A) changes the fluid equilibrium in cylinder (26), such that the hydraulic pressure in area (26B) below the hydraulic cylinder piston (30) creates a force that exceeds the biasing force applied by the internal cylinder spring (38) and collapses the spring (38) into cylinder area (26A) to, correspondingly, retract the cylinder piston rod (32) into the hydraulic cylinder (26) and raise draft shaft assembly (12) from the default float mode position to a pressure mode position.

Figure 2:
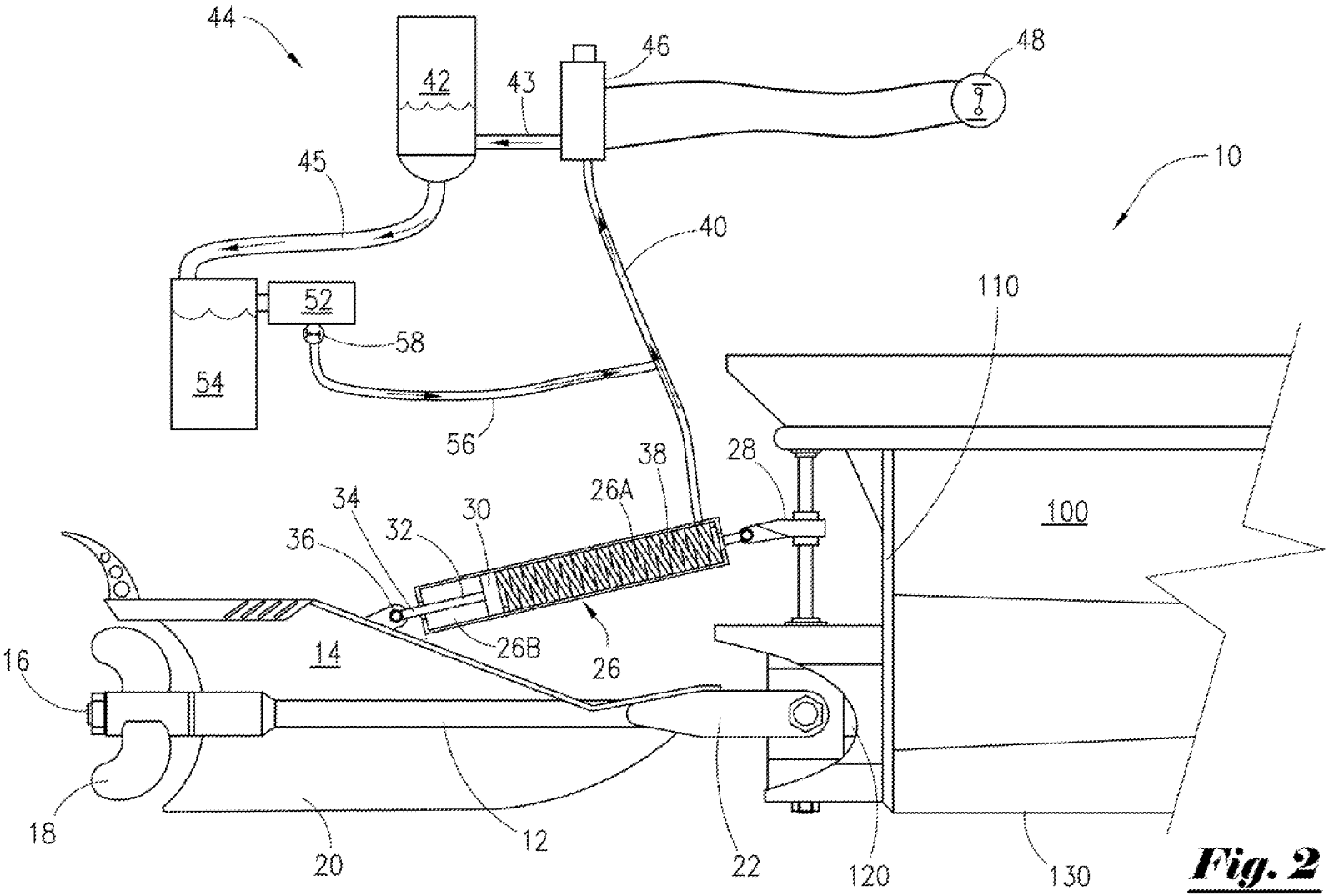
FIG. 2 is a schematic view showing the operation of the marine drive system of FIG. 1.

As shown in FIG. 2, the system (10) is provided with a means (44) for regulating or controlling the flow of hydraulic fluid to and from the hydraulic cylinder (26). One embodiment of the means (44) for controlling the flow of hydraulic fluid to and from the hydraulic cylinder (26) is an electronic solenoid valve (46) that is operatively connected to a multifunction switch (48). Switch (48) has a Pressure On position and a Pressure Off position. When the switch (48) is in the Pressure Off position, electrical power to the solenoid valve (46) is turned off to open valve (46) to allow fluid to be removed or evacuated from cylinder area (26A) and from fluid line (40) and diverted to the fluid reserve tank (42). The fluid diverted from cylinder area (26A) and from fluid line (40) is directed to fluid return line (43) back into the fluid reserve tank (42) where it may be recycled to fluid supply tank (54) through supply return flow line (45). Diverting the fluid from fluid line (40) to fluid line (43) relieves the fluid pressure in area (26A) above the piston (30) in cylinder (26). When the fluid pressure area (26A) is relieved, the fluid pressure in cylinder area (26B) translates piston (30) to compress spring (38) and retract the piston rod (32) into the cylinder (26) raising the drive shaft assembly (12) to the pressure mode position.

Conversely, to maintain the fluid pressure in fluid line (40) and extend piston rod (32) from the cylinder (26) and lower the dive shaft assembly (12), the Pressure Off position of the switch (48) is selected to supply electrical current to close the solenoid valve (48). Closing the solenoid valve (48) allows fluid to be delivered from fluid supply (54) by trim pump (52) from fluid line (56) and line (40) into cylinder area (26A). Returning fluid to cylinder area (26A) equalizes the fluid pressure in cylinder areas (26A) and (26B) above and below piston (30). This in turn allows spring (30) to extend and translate the piston (30) to extend the piston rod (32) from the cylinder (12) and lower the drive shaft assembly (12) to a float mode position. The selective adjustment of the flow of hydraulic fluid to and from the hydraulic cylinder (26) with the solenoid valve (46) and switch (48) allows the position of the draft shaft assembly (12) to be varied between the float mode position and the pressure mode position as desired by the vessel operator.

The means (44) for regulating or controlling the flow of hydraulic fluid to and from the hydraulic cylinder (26) may utilize other types of valve systems, including valve systems employing manual, mechanical, hydraulic, or pneumatic valves.

Figure 3:
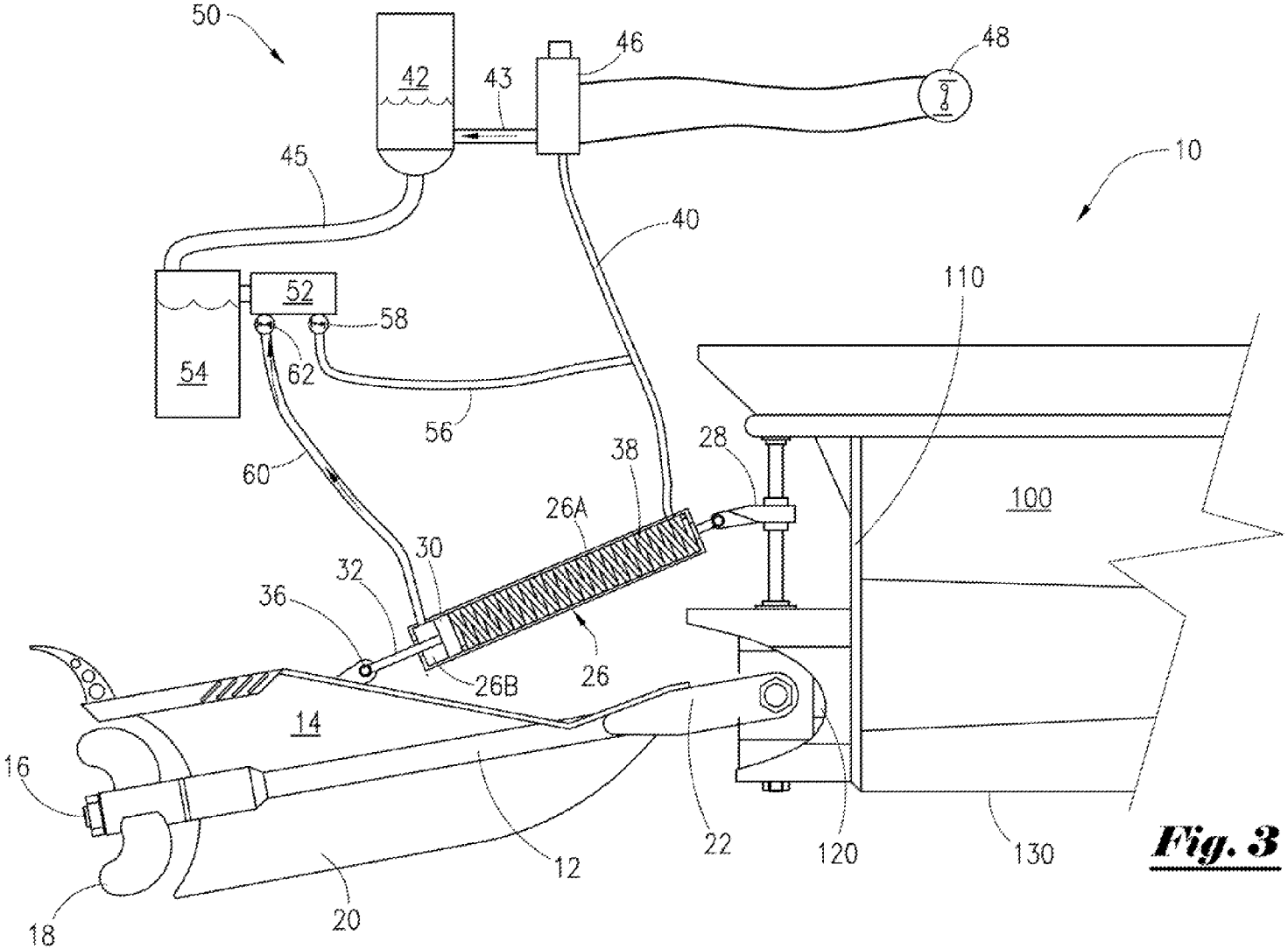
FIG. 3 is a schematic illustration of the marine drive system of FIG. 1 with an associated trim assembly.

As shown in FIG. 3, the system (10) may also be provided with an integrated trim system (50). On embodiment of the integrated trim system (50) is comprised of the hydraulic fluid trim pump (52), an associated trim pump switch (58) in fluid communication with hydraulic fluid supply tank (54) and a connecting fluid line (56) in communication with hydraulic fluid line (40), and fluid return line (45) as shown in FIG. 2. The trim pump switch (58) has a fluid on and fluid off selection. The trim system (50) is further comprised of a hydraulic fluid relief line (60) in communication with area (26B) of hydraulic cylinder (26) and with trim pump (52) and an associated evacuation trim switch (62).

When marine drive system (10) is operating in float mode, the Pressure Off position of switch (48) is selected to close solenoid valve (46). The closed valve (46) blocks fluid flow to fluid reserve tank (42) and fluid is maintained in cylinder area (26A) and line (40) to equalize fluid pressure in cylinder (26), maintain the extension of the spring (38) and the extension of piston rod (32), and hold lower drive shaft assembly (12) in the float mode position. Trim pump (52) pump may be activated by the fluid on position of trim pump switch (58) to supply fluid from fluid supply tank (54) to fluid line (56) in communication with hydraulic fluid line (40) to maintain fluid in cylinder area (26A).

When the drive system (10) is operating in the pressure mode position, the Pressure On position of switch (48) is selected and the solenoid valve (46) opens. Fluid from cylinder area (26A) is then removed through line (40) and directed into fluid reserve tank (42) through line (43). With the fluid in cylinder area (26A) removed, the force generated by spring (38) exceeds the fluid force on piston (30) generated in cylinder area (26B), spring (38) extends to move piston (30) to extend rod (32) from cylinder (26) and lower the drive shaft assembly (12) to a down trim float mode position. Fluid flowing to fluid line (40) from pump (52) through flow line (56) is diverted to flow line (43) into reserve tank (43) and returned to fluid supply tank (54) through flow line (45).

To up trim drive shaft assembly (12) from the pressure mode position, the trim pump switch (62) is used to operatively control the hydraulic fluid trim pump (52) and open a check valve in the fluid trim pump (52) to remove fluid from cylinder area (26B) through fluid relief line (60). Removing fluid from cylinder area (26B) below piston (30) through fluid line (60) reduces the pressure force on cylinder piston (30) in area (26B) allowing spring (38) to extend and translate piston (30) to extend the piston rod (32) from cylinder (26) to pivot drive shaft assembly (12) vertically downward to a desired down trim position.

The fluid trim pump (52) and trim switches (58) and (60) allow for selective adjustment of the fluid through fluid line (40) and fluid relief line (60) to control the pressure force on the cylinder piston (28) against the biasing force of the cylinder spring (38). This allows the vertical position of the drive shaft assembly, to be adjusted from full float mode, as shown in FIG. 4 with equalized fluid pressure on either side of piston (30) with the spring (38) fully extended to a down trim position; to partial float mode, as shown in FIG. 5, with a desired trim fluid pressure in the hydraulic cylinder (26) at area (26B) below piston (30) to partially compress spring (38) to place the drive shaft assembly (12) at a desired up trim position; to pressure mode, as shown in FIG. 6, with fluid pressure in area (26A) above the piston (30) completely relieved to completely compress spring (30) and raise and hold the drive shaft assembly (12) at its maximum up trim position.

The system (10) may also be provided with a trim system that employs other types of trimming mechanisms. These trimming mechanisms may include a standalone electro-mechanical mechanism or a standalone electro-hydraulic system employing one or more hydraulic cylinders such as a double action cylinder.

Figure 4:
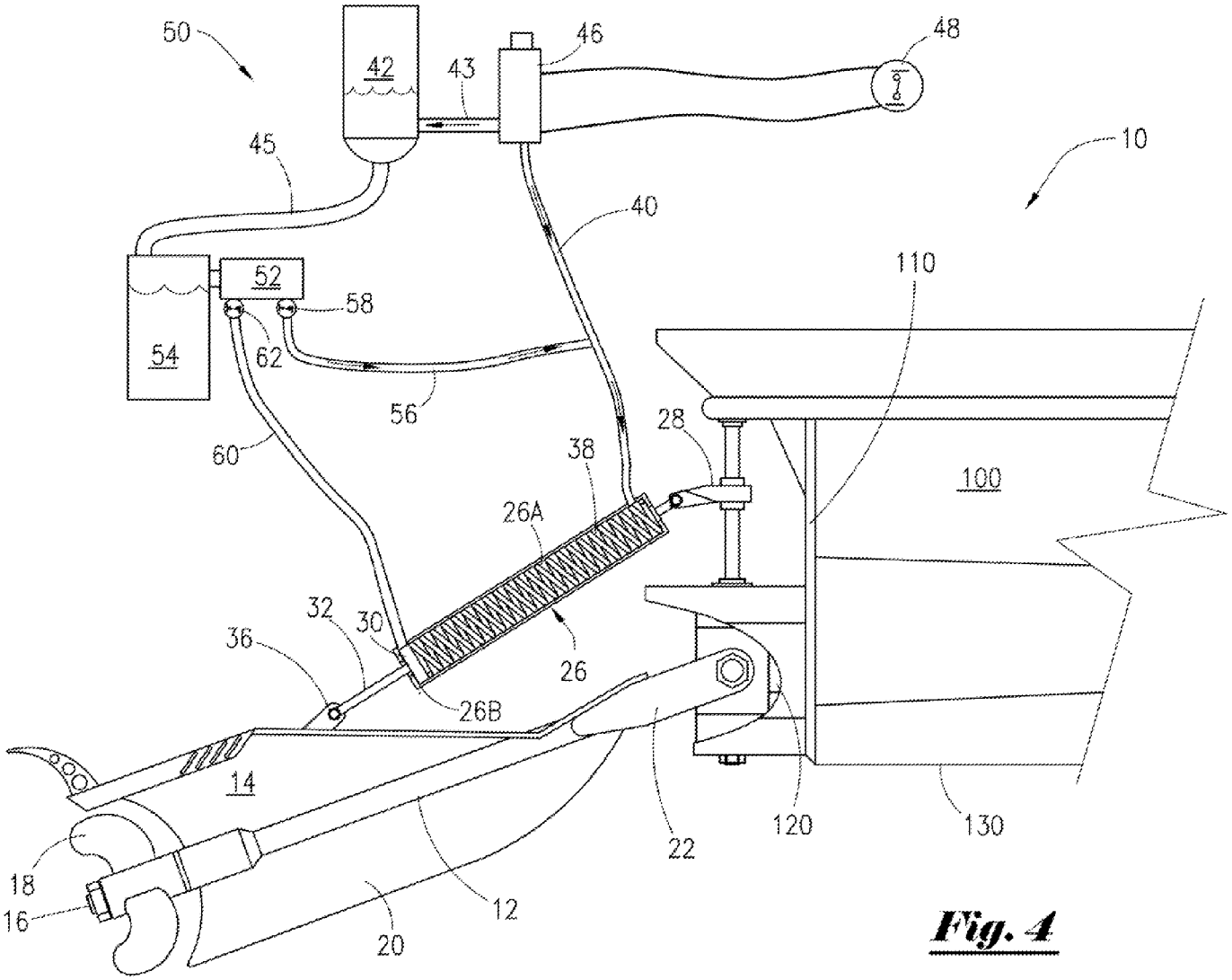
FIG. 4 is a schematic illustration of the marine drive system of FIG. 1 with the system in float mode.
Figure 5:
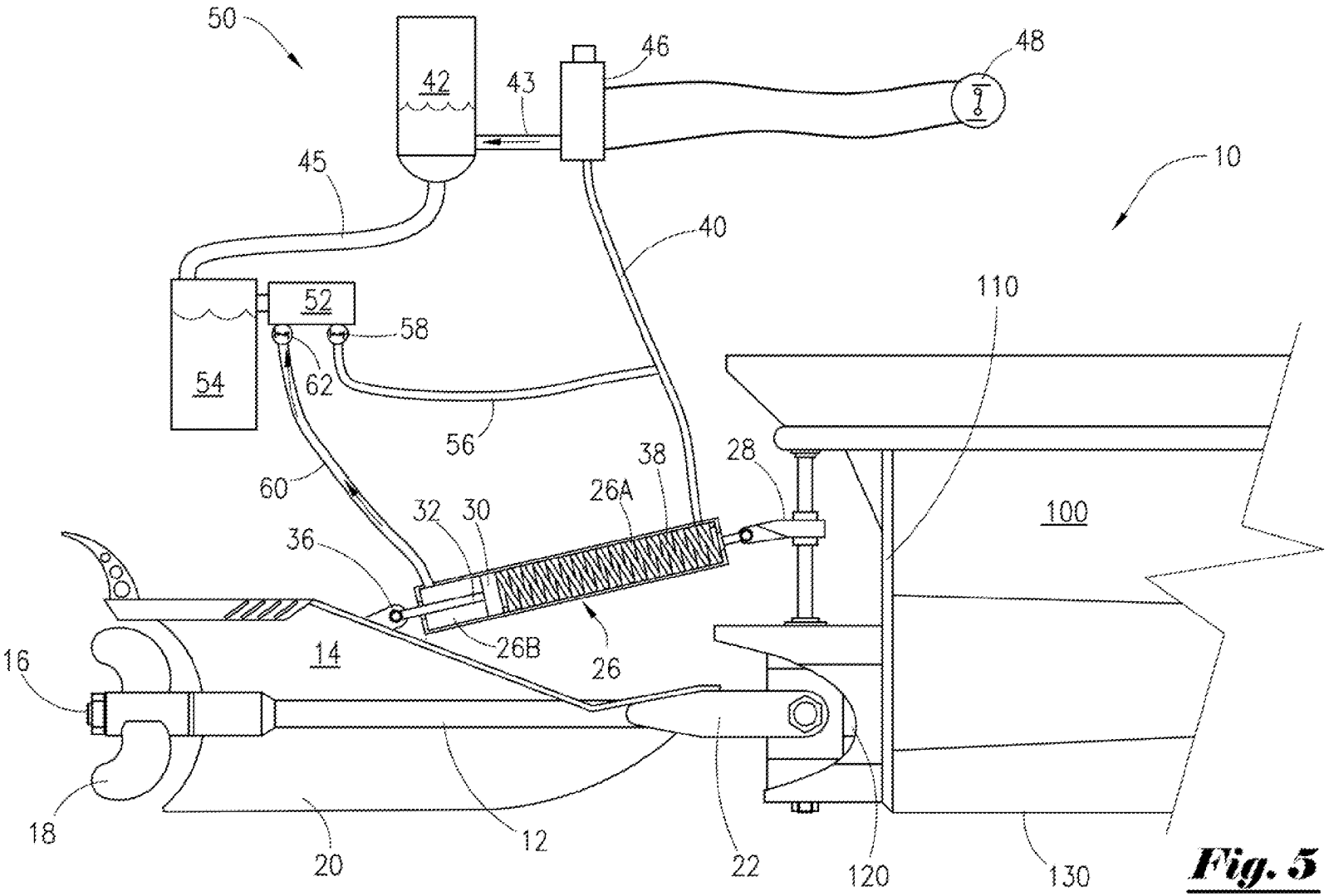
FIG. 5 is a schematic diagram of marine drive system of FIG. 1 with the system in partial float mode.

When the vessel is underway with the system (10), whether in full float mode as shown in FIG. 4 or partial float mode as shown in FIG. 5, the drive shaft assembly (12) will float or glide over obstacles present in the waterway in response to the recoil motion of cylinder (26) in response to its spring (38). This recoil motion provides a controlled drive response to waterway obstacles even when drive shaft assembly (12) is vertically adjusted to various "up trim" or "down trim" positions between the float mode and the pressure mode configurations. The floating or gliding drive shaft assembly (12) in response to obstacles, such as logs and stumps, allows a vessel (100) employing the system (10) to be used in shallow, marshy, swampy or obstacle strewn marine environments. Such a controlled response is not possible with conventional outboard motor hydraulic systems which release at preset pressures and, depending on speed of vessel and the density of objected encountered, can instantly damage the lower drive unit of the outboard motor, including the gear case and drive shaft, or completely rip or tear the lower drive unit from the outboard motor.

Figure 6:
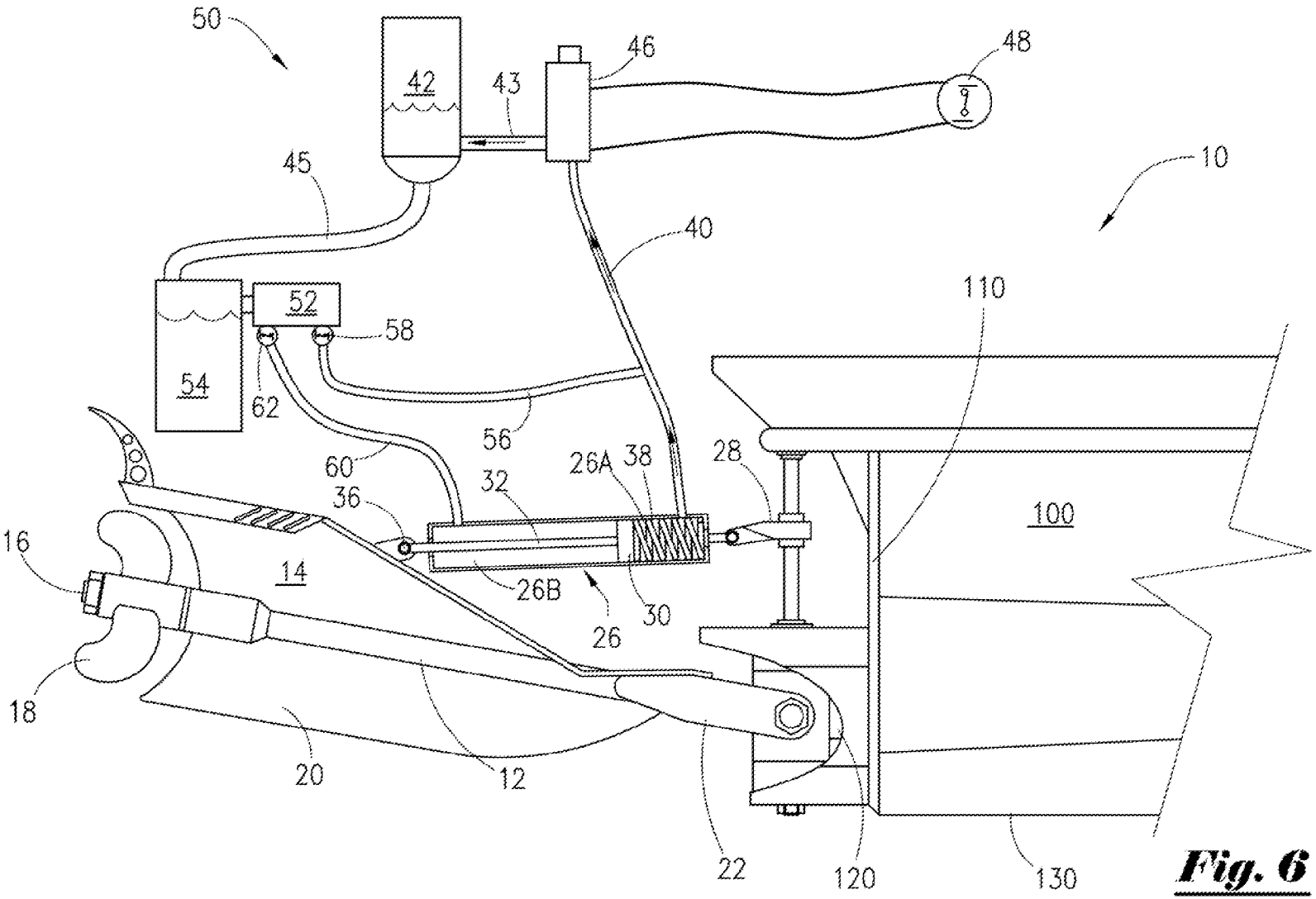
FIG. 6 is a schematic diagram of marine drive system of FIG. 1 with the system in pressure mode.

When the vessel is underway with the system (10), in the pressure mode as shown in FIG. 6, the drive shaft assembly is raised to its highest up trim position. This allows the maximum drive shaft torque to be applied with a minimum of recoil motion of the drive shaft assembly (12). The pressure mode position is particularly useful when the vessel (100) is being operated in extremely shallow waterways with soft muddy bottoms such as those typically encountered in shallow marsh environments. With the draft shaft assembly (12) in the pressure mode position, the propeller assembly (18) can chum up a muddy water bottom that otherwise impede or fully prevent the propulsion of a vessel to create a soft slurry to allow advancement of the vessel.

FIG. 7 is a top schematic view of a vessel (100) employing the marine drive assembly (10). There is shown the drive shaft assembly (12) with the housing (14), drive shaft (16) and drive shaft (16), and propeller assembly (18). The proximal end (22) of drive shaft assembly (12) is pivotally attached at the stern (110) of the vessel (100) by the universal joint mechanism (120). The universal joint (120) allows the drive shaft assembly (12) to be selectively pivoted horizontally, i.e., toward the port or starboard side of the vessel (100) along the arc designated as B-B, with a suitable steering mechanism.

The wide operational position range of the drive shaft assembly (12) of the marine drive system (10) described above, allows the system (10) to be used in substantially all types of marine environments. This makes the marine drive system suitable for commercial marine activities such as for providing marine access to remote areas for surveying and mapping, for the exploration of fluid and gas, and pipeline inspection. The marine drive system (10) may also be used in military operations to provide marine access to areas otherwise inaccessible by boats or vessels. The marine drive system (10) may also be adapted for use on many recreational vessels such as those used for hunting and fishing in marshy or swampy areas.

LISTING OF DRAWING REFERENCES

| | |
|---|---|
| (10) | marine drive system |
| (12) | drive shaft assembly |
| (14) | housing |
| (16) | drive shaft |
| (18) | propeller assembly |
| (20) | skeg |
| (22) | drive shaft assembly end |
| (26) | hydraulic cylinder |
| (26A) | cylinder area |
| (26B) | cylinder area |
| (28) | cylinder universal joint |
| (30) | cylinder piston |
| (32) | piston rod |
| (34) | piston rod distal end |
| (36) | pivot connection |
| (38) | internal spring |
| (40) | fluid line |
| (42) | fluid reserve tank |
| (43) | reserve tank fluid return line |
| (44) | means for controlling the flow of hydraulic fluid |
| (45) | fluid supply return line |
| (46) | electronic solenoid valve |
| (48) | multifunction switch |
| (50) | integrated trim system |
| (52) | hydraulic fluid trim pump |
| (54) | hydraulic fluid supply tank |
| (56) | connecting trim fluid line |
| (58) | trim pump switch |
| (60) | hydraulic fluid relief line |
| (62) | evacuation trim switch |
| (100) | marine vessel |
| (110) | vessel stern |
| (120) | universal joint mechanism |
| (130) | vessel bottom |

The description and drawings provided are only an exemplary embodiment of the marine drive system (10) and not for limitation as the invention can be practiced by other than that described and illustrated. The relationship of the spring (38) and piston (30) within the hydraulic cylinder (26) could be reversed and that the cylinder entry points of flow lines (40) and (60) could be adjusted accordingly without changing the function of the marine drive system (10). Changes may also be made in the form, construction, and arrangement of the other parts of the described marine drive system (10) without departing from the spirit and scope of the invention or sacrificing any material advantages.

I claim:

1. A marine drive system comprising:

(a) a drive shaft assembly pivotally attached to a vessel;

(b) a hydraulic cylinder pivotally attached to said vessel;

(c) a translatable piston positioned within said hydraulic cylinder, said piston separating said hydraulic cylinder into a first cylinder area and a second cylinder area, said piston having a piston rod with a first end attached to said piston and a second end extending outward from said cylinder and pivotally attached to said drive shaft assembly;

(d) a coiled spring positioned within said first cylinder area of said hydraulic cylinder, said spring extending to providing a spring force translating said piston toward said second cylinder area thereby extending said piston rod from said cylinder to lower said drive shaft assembly;

(e) fluid filling said cylinder including said first and said second cylinder areas; and (f) a cylinder flow line from said first cylinder area of said hydraulic cylinder whereby said fluid in said first cylinder area may be evacuated to reduce fluid pressure to translate said piston to compress said spring thereby retracting said piston rod into said cylinder to raise said drive shaft assembly.

2. The marine drive system of claim 1, further comprising:

(a) a fluid reserve tank in fluid communication with said cylinder flow line; and (b) a valve controlling flow from said cylinder flow line to said fluid reserve tank whereby fluid evacuated from said first cylinder area may be directed.

3. The marine drive system recited in claim 2, further comprising:

(a) a fluid supply; and (b) a fluid supply line in fluid communication with said cylinder flow line and said fluid supply.

4. The marine drive system recited in claim 3, further comprising:

(a) a pump delivering fluid from said fluid supply to said fluid supply line; and (b) a switch for controlling said pump.

5. The marine drive system recited in claim 4 wherein said valve controlling flow from said cylinder flow line to said fluid reserve tank is an electric solenoid valve controlled by a selectively positionable multifunction switch.

6. The marine drive system as recited in claim 1 further comprising:

(a) a fluid relief flow line from said second cylinder area of said hydraulic cylinder;

(b) a fluid relief valve in communication with said fluid relief flow line controlling fluid from said from second cylinder area of said hydraulic cylinder; and (c) a switch selectively controlling said fluid relief valve.

7. The marine drive system as recited in claim 6 wherein and said fluid relief flow line is in communication with a pump and a return flow line in communication with said fluid supply.

8. The marine drive system as recited in claim 4 further comprising:

(a) a fluid relief flow line from said second cylinder area of said hydraulic cylinder, (b) a fluid relief valve in communication with said fluid relief flow line controlling fluid from said from second cylinder area of said hydraulic cylinder; and (c) a switch selectively controlling said fluid relief valve.

9. The marine drive system as recited in claim 8 wherein said fluid relief flow line is in communication with a pump and a return flow line in communication with said fluid supply.

10. The marine drive system recited in claim 9 wherein said valve controlling flow from said cylinder flow line to said fluid reserve tank is an electric solenoid valve controlled by a selectively positionable multifunction switch.

11. A marine drive system comprising:

(a) a longitudinally extending drive shaft assembly pivotally attached to a vessel;

(b) a hydraulic cylinder pivotally attached to said vessel;

(c) a translatable piston positioned within said hydraulic cylinder, said piston separating said hydraulic cylinder into a first cylinder area and a second cylinder area, said piston having a piston rod with a first end attached to said piston and a second end extending outward from said cylinder and pivotally attached to said drive shaft assembly;

(d) a coiled spring positioned within said first cylinder area of said hydraulic cylinder providing a spring force translating said piston toward said second cylinder area extending said piston rod from said cylinder;

(e) fluid filling said cylinder including said first and said second cylinder areas;

(f) a cylinder flow line from said first cylinder area of said hydraulic cylinder whereby said fluid in said first cylinder area may be evacuated;

(g) a fluid reserve tank in fluid communication with said cylinder flow line; and (h) a valve controlling flow from said cylinder flow line to said fluid reserve tank whereby fluid evacuated from said first cylinder area may be directed.

12. The marine drive system recited in claim 11 wherein said valve controlling flow from said cylinder flow line to said fluid reserve tank is an electric solenoid valve controlled by a selectively positionable multifunction switch.

13. The marine drive system recited in claim 12, further comprising:

(a) a fluid supply;

(b) a fluid supply line in fluid communication with said cylinder flow line and said fluid supply;

(c) a pump delivering fluid from said fluid supply to said fluid supply line; and (d) a switch for controlling said pump.

14. The marine drive system recited in claim 13, further comprising:

(a) a fluid relief flow line from said second cylinder area of said hydraulic cylinder;

(b) a fluid relief valve in communication with said fluid relief flow line controlling fluid from said second cylinder area of said hydraulic cylinder; and (c) a switch selectively controlling said fluid relief valve.

15. A method for propelling a vessel in shallow or obstacle strewn waterways comprising the steps of:

(a) providing a vessel having an engine for transmitting engine torque and rotation;

(b) providing a drive shaft assembly having a housing enclosing a drive shaft having an attached propeller and a skeg;

(c) attaching said drive shaft assembly to said vessel to allow said drive shaft to pivotally move vertically and horizontally;

(d) attaching said drive shaft to said engine to allow transmission of torque and rotation to said propeller pivotal movement vertically and horizontally in relation to said pivotal movement of said drive shaft assembly;

(e) providing a hydraulic cylinder, said cylinder having a translatable piston positioned within said hydraulic cylinder providing a first cylinder area and a second cylinder area, said piston having a piston rod with a first end attached to said piston and a second end extending outward from said cylinder, said first cylinder area of said hydraulic cylinder having a coiled providing a spring force translating said piston toward said second cylinder area thereby extending said piston rod from said cylinder and lowering said;

(f) filling said cylinder, including said first and said second cylinder areas, with fluid;

(g) pivotally attaching said cylinder to said vessel and said second end of said piston rod to said drive shaft assembly housing; and (h) pivotally raising said pivotally mounting drive shaft assembly by removing fluid from said first cylinder area.

16. The method for propelling a vessel in shallow or obstacle strewn waterways recited in claim 15 comprising the additional step of lowering said pivotally mounting drive shaft assembly by removing fluid from said second cylinder area.

17. The method for propelling a vessel in shallow or obstacle strewn waterways recited in claim 15 wherein the step of removing fluid from said first cylinder area includes:

(a) providing a cylinder flow line from said first cylinder area in fluid communication with a fluid reserve tank; and (b) controlling flow from said cylinder flow line to said fluid reserve tank whereby fluid evacuated from said first cylinder area may be directed.

18. The method for propelling a vessel in shallow or obstacle strewn waterways recited in claim 16 comprising the additional steps of:

(a) providing a fluid relief flow line from said second cylinder area;

(b) providing a pump and a controllable fluid relief valve in communication with said fluid relief flow line whereby fluid is removable from said second cylinder area; and (c) controlling said fluid relief valve and removing fluid from said second cylinder area through said fluid relief line thereby pivotally lowering said pivotally mounting drive shaft assembly.

19. The method for propelling a vessel in shallow or obstacle strewn waterways comprising the steps of:

(a) pivotally attaching a longitudinally extending drive shaft assembly to the stern of a vessel; and (b) pivotally attaching a hydraulic cylinder with an internal spring biased translatable cylinder piston and rod between said vessel and said drive shaft assembly, said spring biased piston configured between a first fluid filled cylinder chamber retaining a coiled spring and a second fluid cylinder chamber, whereby said piston is urged through said second fluid cylinder chamber thereby extending said rod and lowering said drive shaft assembly.

20. The method for propelling a vessel in shallow or obstacle strewn waterways recited in claim 19 comprising the additional steps of:

(a) fluidly connecting said first fluid filled cylinder chamber to a fluid reserve; and (b) evacuating fluid from said first fluid filled cylinder chamber to said fluid reserve thereby retracting said rod and raising said drive shaft assembly.

21. The method for propelling a vessel in shallow or obstacle strewn waterways recited in claim 19 comprising the additional steps of:

(a) fluidly connecting said second fluid filled cylinder chamber to a fluid relief line; and (b) removing fluid from said second fluid filled cylinder chamber thereby extending said rod and lowering said drive shaft assembly.

22. A marine drive system comprising:

(a) a drive shaft assembly pivotally attached to the stem of a vessel; and (b) a hydraulic cylinder with an internal spring biased translatable cylinder piston having and attached piston rod, said piston configured between a first fluid filled cylinder chamber retaining a coiled spring and a second fluid cylinder chamber, whereby said piston is urged through said second fluid cylinder chamber to extend said rod from said hydraulic cylinder; and (c) wherein said hydraulic cylinder and said rod are pivotally attached between said vessel and said drive shaft assembly whereby said extended rod lowers said drive shaft assembly.

23. The marine drive assembly recited in claim 22 further comprising:

(a) a cylinder flow line fluidly connected to said first fluid filled cylinder chamber and a fluid reserve; and (b) means for diverting fluid from said cylinder flow line to said fluid reserve whereby fluid is evacuated from said first fluid filled cylinder thereby reducing fluid pressure in said first fluid filled cylinder to move said piston and compress said spring to retract said rod into said cylinder and raise said drive shaft assembly.

24. The marine drive assembly recited in claim 23 further comprising:

(a) a fluid relief line fluidly connecting said second fluid filled cylinder chamber to a fluid tank; and (b) means for removing fluid from said second fluid filled cylinder chamber through said fluid relief line to said fluid tank thereby reducing fluid pressure in said second fluid filled cylinder chamber extending said spring to move said piston to extend said rod and lower said drive shaft assembly.

25. The marine drive assembly recited in claim 23 wherein said means for diverting for diverting fluid from said cylinder flow line to said fluid reserve includes an electric solenoid valve controlled by a selectively positionable multifunction switch.

26. The marine drive assembly recited in claim 24 wherein said means for removing fluid from said second fluid filled cylinder chamber through said fluid relief line includes a switch controlled pump.

27. A marine drive system comprising:

(a) a drive shaft assembly pivotally attached to the stem of a vessel; and (b) a hydraulic cylinder with an internal spring biased translatable cylinder piston having and attached piston rod, said piston configured between a first fluid filled cylinder chamber retaining a coiled spring and a second fluid cylinder chamber, whereby said piston is urged through said second fluid cylinder chamber to extend said rod from said hydraulic cylinder; and wherein said hydraulic cylinder and said rod are pivotally attached between said vessel and said drive shaft assembly whereby said extended rod lowers said drive shaft assembly;

(c) a cylinder flow line fluidly connected to said first fluid filled cylinder chamber and a fluid reserve; and (d) an electric solenoid valve controlled by a selectively positionable multifunction switch in communication with said cylinder flow line selectively diverting fluid to said fluid reserve from said first fluid filled cylinder thereby reducing fluid pressure in said first fluid filled cylinder to move said piston and compress said spring to retract said rod into said cylinder and raise said drive shaft assembly.

28. The marine drive assembly recited in claim 27 further comprising:

(a) a fluid relief line fluidly connecting said second fluid filled cylinder chamber to a fluid tank; and (b) a switch controlled pump whereby fluid is removed from said second fluid filled cylinder chamber through said fluid relief line to said fluid tank thereby reducing fluid pressure in said second fluid filled cylinder chamber extending said spring to move said piston to extend said rod and lower said drive shaft assembly.

29. An improved marine drive system for a marine vessel comprising:

(a) a longitudinally extending drive shaft assembly pivotally attached to a vessel;

(b) a hydraulic cylinder with a translatable piston and rod pivotally attached between said drive shaft assembly and said vessel;

(c) a first fluid filled chamber in said cylinder retaining a coiled spring urging said translatable cylinder piston through a second fluid chamber in said cylinder to extend the piston rod from said hydraulic cylinder to lower said drive shaft assembly;

(d) a first fluid line in communication with a switch controlled valve whereby fluid is selectively evacuated from said first fluid filled chamber to reduce fluid pressure therein thereby moving said piston to compress said spring and retract said rod in response to fluid pressure in said second fluid chamber to raise said drive shaft assembly; and (e) a second fluid line in communication with a switch controlled valve whereby fluid is selectively removed from the second fluid filed chamber to reduce fluid pressure therein thereby moving said piston in response to said spring to extend said rod to lower said subsequently raised drive shaft assembly.

* * * * *